United States Patent [19]

Tuson et al.

[11] 4,351,260

[45] Sep. 28, 1982

[54] ARRANGEMENT FOR MOORING A FLOATING BODY SUCH AS A SHIP

[75] Inventors: Samuel Tuson, Mesnil-le-Roi; Robert Vilain, Maisons-Alfort, both of France

[73] Assignee: Entreprise d'Equipements Mecaniques et Hydrauliques, E.M.H., France

[21] Appl. No.: 256,984

[22] Filed: Apr. 24, 1981

Related U.S. Application Data

[63] Continuation of Ser. No. 21,716, Mar. 19, 1979, abandoned.

[30] Foreign Application Priority Data

Mar. 24, 1978 [FR] France ..... 78 08760

[51] Int. Cl.[3] ..... B63B 21/00

[52] U.S. Cl. ..... 114/230

[58] Field of Search ..... 9/8 P, 8.3 R; 114/230; 141/387, 388

[56] References Cited

U.S. PATENT DOCUMENTS

| | | | |
|---|---|---|---|
| 3,783,816 | 1/1974 | de Chassy et al. | 114/230 |
| 3,823,432 | 7/1974 | Van Heijst | 9/8 P |
| 4,010,500 | 3/1977 | Reid, Jr. | 9/8 P |

FOREIGN PATENT DOCUMENTS

| | | | |
|---|---|---|---|
| 2159703 | 6/1973 | France | 9/8 P |
| 2230543 | 12/1974 | France | 9/8 P |

*Primary Examiner*—Trygve M. Blix
*Assistant Examiner*—Jesus D. Sotelo
*Attorney, Agent, or Firm*—Steinberg & Raskin

[57] ABSTRACT

The invention relates to a system for mooring a floating contrivance such as a ship, the system comprises at least one lever arm pivotally connected to the ship on the one hand and to a mooring device on the other hand, and a counterweight directly secured to the lever arm at a portion thereof located outside of the ship and always submerged in the sea water.

6 Claims, 12 Drawing Figures

1
6
8
9
10
43
44
45
46
47
48
48a
49
50
51
52
53
54
55
56
57

1
6
8
9
10
18
40
41
42
43
44
45
46
47
48
48a
49

1
6
8
9
10
70
71
72
73
74
75
76
77
78

6
9
63a
63b
64
66
67

VIII
1
6
8
9
10
60
61
62
63a
63b
64
65

ARRANGEMENT FOR MOORING A FLOATING BODY SUCH AS A SHIP

This is a continuation, of application Ser. No. 21,716, filed Mar. 19, 1979 now abandoned.

The invention relates generally to a system or arrangement for mooring a floating body and is more particularly directed to a mooring device of the kind including a counterweight and in particular usable for mooring ships on working sites for exploiting or mining sea beds.

The exploitation or operation of certain oil fields as well as other industrial applications may require the permanent off-shore mooring of ships or floating bodies at sea which are used for the storage of products or for supporting equipment or treating plants for processing or transforming such products.

In the case of an operating site exposed to bad weather hazards and to strong swells or rough sea conditions the known mooring means are inadequate as undergoing inadmissible stresses in particular in relation to stationary towers and to buoys. Even articulated columns or like compliant or oscillating platforms may undergo on account of a strong swell stresses or strains likely to generate very substantial interfering forces if such motions are hindered or impeded by their connections with the ship as generally is the case.

The desirable features of a particular permanent mooring system are the following:

enabling the ship to make a long displacement under the actions of different variations induced for instance by the sea condition, being of a simple structural design without in particular any winches, chains and cables or ropes which may very easily be subject to failures at sea, avoiding as much as possible the use of auxiliary floats or like buoyant bodies which under the effect of the swell would generate harmful interfering forces, and allowing damping systems to be readily combined therewith.

The invention provides a mooring system incorporating the aforesaid features and which may make use of stationary columns or platforms as well as of articulated columns and like compliant or oscillating platforms as mooring or fastening points.

The invention therefore provides an arrangement for mooring a floating appliance such as a ship, of the kind including a counterweight creating a stable equilibrium position with a self-acting restoring or biasing force urging the system towards that position, said system being of the type comprising at least one lever arm pivotally connected on the one hand to the ship and on the other hand to a mooring device and being characterized in that the counterweight is directly secured to said lever arm at a portion thereof located outside of the ship and constantly submerged in the sea water.

According to another characterizing feature of the invention the mooring system comprises two lever arms pivotally connected to each other and the opposite ends of which are pivotally connected to the ship and to the mooring device, respectively.

According to a further characterizing feature of the invention the mooring device consists of a column which may be articulated or not and either emergent or fully submerged.

According to still another characterizing feature of the invention the counterweight is suspended either from the mooring device or from the ship.

According to a further characterizing feature of the invention the counterweight is suspended from an intermediate element such as a float or like buoyant body positioned between the ship and the mooring device.

The invention will be better understood and further objects, characterizing features, advantages and details thereof will appear more clearly as the following explanatory description proceeds with reference to the accompanying diagrammatic drawings given by way of non limiting examples only illustrating several presently preferred specific embodiments of the invention and wherein.

Figure 1:
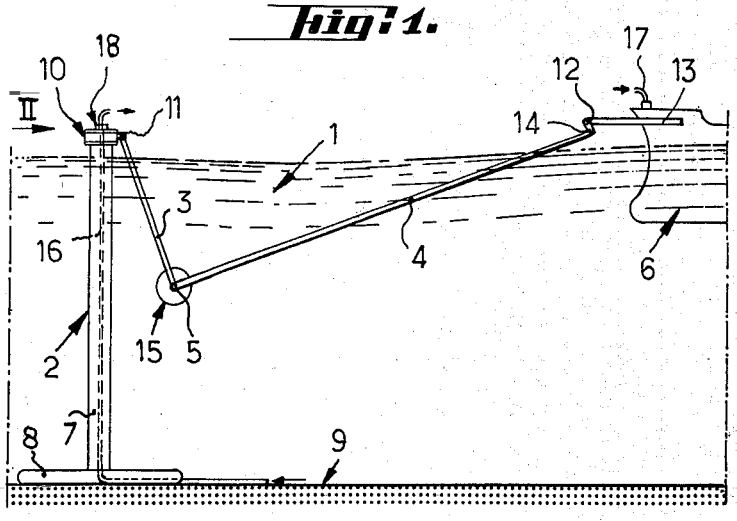
FIG. 1 is a partial elevational view of a first embodiment of a mooring system according to the invention.
Figure 2:
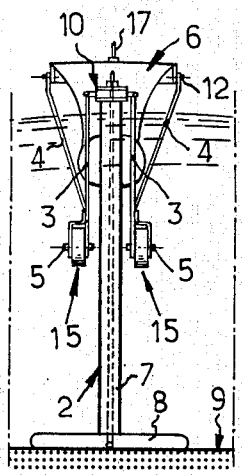
FIG. 2 is an end view seen in the direction of the arrow II in FIG. 1.

Referring to FIGS. 1 and 2 the mooring system 1 according to a first embodiment of the invention comprises a mooring device 2 and a pair of lever arms 3, 4 arranged in a substantially vertical plane and pivotally connected to each other for swinging motion about a substantially horizontal pivot axis or pin 5. The lever arm 3 is pivotally connected with its free end in a substantially vertical plane to the mooring device 2 whereas the lever arm 4 is pivotally connected also in a substantially vertical plane to a floating body 6 such as a ship.

The mooring device in the examplary embodiment shown consists of a stationary emergent column 7 rigidly fast with a base member 8 resting or anchored onto the sea floor or bottom 9. A swivelling or revolvable mooring head 10 is rotatably mounted at the emerged portion of the stationary column 7 in coaxial relationship therewith.

The lever arm 3 is pivotally connected to this mooring head 10 for swivelling motion about a substantially horizontal axis 11 carried by said head. The lever arm 4 is pivotally connected to the ship 6 for swinging motion about an axis or pin 12 carried at the end of a support or holder 13 which projects from and beyond the stern i.e.

the rear end or the prow or bow i.e. the fore end of the ship while being fast therewith with its other end.

As shown in FIG. 1, the lever arm 4 may be pivotally connected for swinging motion about the axis 12 through a crank member or lug 14 rigidly connected to said lever arm and making a fixed angle therewith such that the point of coupling between the crank member 14 and the lever arm 4 is brought closer to the centre of roll. In this manner the transverse forces exerted upon the lever arm when the ship is rolling are limited.

The mooring system 1 also comprises a counterweight 15 which in the examplary embodiment shown is mounted at the submerged end of the lever arm 3 i.e. the counterweight 15 is suspended from the mooring device 2. The pivot axis or pin 5 provided between both lever arms 3 and 4 may be used for mounting this counterweight 15.

Referring more particularly to FIG. 2 the mooring system consists advantageously of two sets of lever arms 3, 4 arranged in two vertical planes located on either side, respectively, of the longitudinal axis of the ship 6 and which sets are associated with two counterweights 15, respectively.

The fluid-conveying connecting lines between at least one duct or riser 16 supported by the column and leading for instance to a submarine well-head on the one hand and a pipeline 17 carried by the ship 6 may be effected either by means of ducts secured to the lever arms 3, 4 or by means of independent flexible or yielding hoses suspended from a boom carried by the column 2 or by the ship 6. It should be understood that owing to the motions of the ship it is necessary to provide at least one revolving or swivel joint or like rotary coupling seal 18 for instance at the mooring head 10 to allow for the proper flow of a fluid between one duct or riser of the column and the ship.

Figure 3:
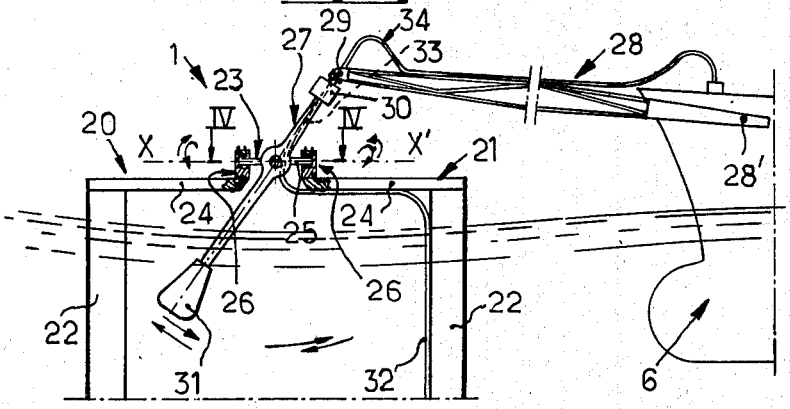
FIG. 3 is a fragmentary elevational view, with parts broken away, of a second embodiment of the mooring system according to the invention.
Figure 4:
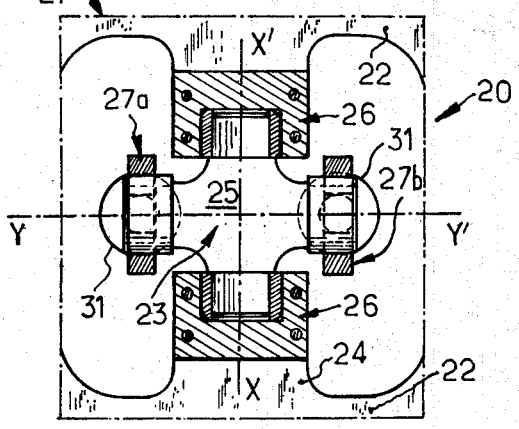
FIG. 4 shows a view in cross-section taken upon the line IV—IV of FIG. 3.

With reference to FIGS. 3 and 4, a second embodiment of the mooring system according to the invention will now be described.

As in the foregoing embodiment the mooring system 1 comprises a mooring device 20 consisting for instance of a base member (not shown) resting or anchored onto the sea bed or bottom and which carries an emergent construction 21 consisting of at least two upright posts, standards or like legs 22. At the emerging portion of the construction 21 the two posts 22 carry substantially midway therebetween an universal Cardan joint 23 connected to both pillars or posts 22 by means of two substantially horizontal plates 24, respectively.

The cross member or spider of the universal Cardan joint 25 is pivotally mounted for rotation about the axis XX′ whereas the lever arm 27 is pivotally mounted for swinging motion about the second axis YY′ of the cross member or spider of the Cardan joint, which last-named axis extends substantially at right angles to the first axis XX′. The axis XX′ is carried by the mooring device 20 through the medium of two bearings 26 supported by both horizontal plates 24, respectively, of the framework construction 21 of the mooring device 20.

The mooring system 1 comprises in this second embodiment one single lever arm 27 pivotally connected on the one hand for swinging motion about a second axis of rotation YY′ of the cross member or spider of the Cardan joint 25 and on the other hand to the free end of an elongated structure 28 pivotally connected at 28′ to the stern or aft end or to the prow, bow or fore end of the ship 6. In this embodiment the lever arm 27 actually forms a pendulum pivotally connected with its upper end to the overhanging or projecting structure 28 for swinging motion about an axis 29, with a rotary joint 30 being interposed in coaxial relationship with the longitudinal axis of the arm 27 whereas its other end carries a counterweight 31 always submerged in the sea water.

Referring in particular to FIG. 4 it should be pointed out that the pendulum 27 at its portion located at the level of the universal Cardan joint 23 is divided into two portions *27a,27b* between which the cross member or spider of the Cardan joint 25 is arranged so as to mount the pendulum 27 for swinging motion about the axis YY′.

The fluid flow-conveying connecting lines between the mooring device 20 and the ship 6 may consist for instance of at least one duct or riser 32 carried by the construction 21 of the mooring device, which duct is extended by a pipe-line 33 made fast with the top portion of the pendulum 27 while extending along an axis of swing of the Cardan joint 23 as known per se. With its free end the pipe-line 32 may be coupled to a flexible or yielding hose 34 by means of a revolving joint 30, which hose connects to the ship 6.

In the two first embodiments which have just been described the counterweights 15, 31 are suspended from the mooring device.

Figure 5:
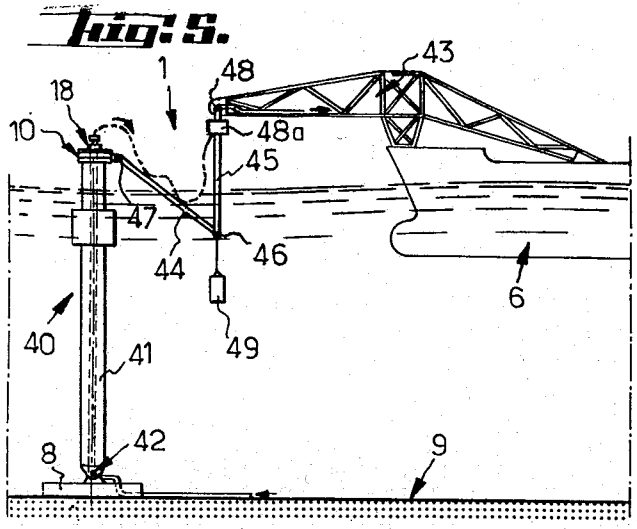
FIG. 5 is a partial elevational view of a third embodiment of a mooring system according to the invention.

In the third embodiment shown in FIG. 5, the mooring system 1 comprises a mooring device 40 consisting of an articulated or compliant emergent column 41 pivotally connected for oscillating motion to a base member 8 resting or anchored onto the sea floor 9 by means of a universal Cardan joint 42. At the emerged top portion of the column 41 is mounted a swivelling or rotary head 10 as in the first embodiment illustrated in FIG. 1.

The ship 6 is fitted at her prow or fore end or at her stern or rear end with an overhanging or projecting structure 43 forming a kind of boom or jib and extending substantially along the longitudinal axis of the ship 6.

For providing the connection between the ship 6 and the rotary head 10 the mooring system comprises two lever arms 44, 45 linked to each other for swinging motion about a horizontal axis or pin 46. The free end of the lever arm 44 is pivotally connected to the revolving head 10 for swinging motion about a substantially horizontal pivot pin axis whereas the free end of the lever arm 45 is pivotally connected to the overhanging boom or jib structure 43 for swinging motion about a substantially horizontal pivot pin axis 48 with a rotary joint **48*a* being interposed in coaxial relation to the longitudinal axis of the lever arm 44. A counterweight 49 is mounted in prolongation of the lever arm 45 and is always submerged in the sea water. It should be noted that the overhanging boom or jib structure 43 should be long enough to avoid any colliding with the mooring point when the ship 6 is moving towards the mooring point. The fluid flow-conveying connecting lines between the column 41 and the ship 6** are provided for instance in the same manner as that described with reference to the foregoing embodiments.

Figure 6:
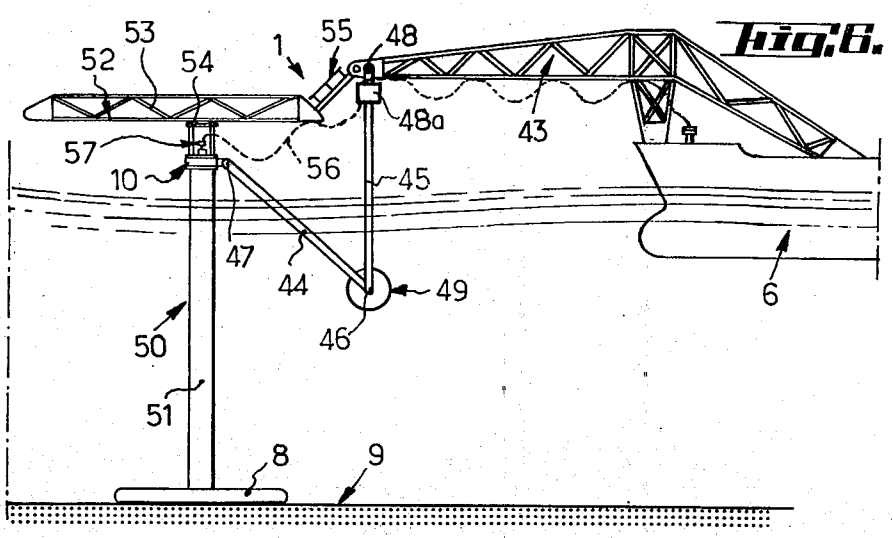
FIG. 6 is a fragmentary elevational view showing a fourth embodiment of a mooring system according to the invention.

Referring to FIG. 6 there is shown a fourth embodiment of the invention which actually is an alternative or modification of the third embodiment illustrated in FIG. 5. In this examplary embodiment the mooring system 1 differs from the foregoing one by the mooring device 5 which consists of a stationary emergent column 51 and by the addition of a damping contrivance 52. The latter consists of a gangway or like catwalk 53 provided between the mooring device 50 and the ship 6. This gangway 53 is pivotally connected with one end to the overhanging a boom or jib structure 43 and substantially in prolongation thereof. This gangway or catwalk 53 freely rests through the agency of sliding pads or skids 54 onto the top end surface of the mooring head 10. Therefore this gangway 53 is in guided sliding engagement with the mooring device 50 thereby enabling the motions of the ship 6 to be damped through sliding friction. The gangway combined with the overhanging boom structure 43 may advantageously be used under calm sea conditions as an access or communication means between the mooring device 50 and the ship 6. The connection between the gangway 53 and the overhanging boom structure 43 may be provided through the agency of a small or short foot-bridge 55 pivotally mounted at its two opposite ends. The fluid flow-conveying connections between the column 50 and the ship 6 may be made by means of at least one flexible hose-pipe 56, a rotary joint 57 (on the mooring head) and the rotary joint 48*a*.

It should be pointed out that the length of the overhanging boom structure 43 should be such that it may extend above the gangway 53 during the swinging motions of the ship about the lever arm 45 for avoiding collision.

Figure 8:
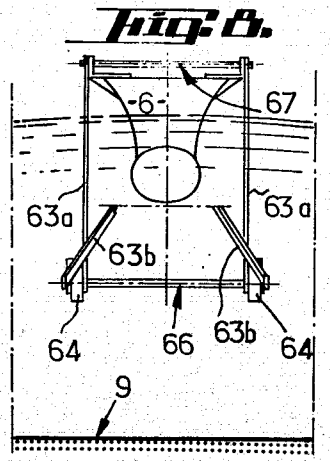
FIG. 8 is an end view seen in the direction of the arrow VIII in FIG. 7.
Figure 7:
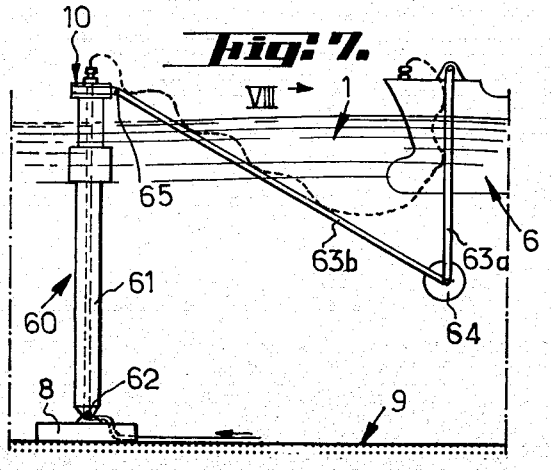
FIG. 7 is a partial elevational view of a fifth embodiment of a mooring system according to the invention.

With reference to FIGS. 7 and 8 a fifth embodiment of the mooring system 1 according to the invention will be described. The mooring device 60 consists of an articulated emergent column 61 pivotally connected to a base member 8 through the agency of a universal Cardan joint 62. At the emerged part of the column 61 is mounted a swivelling or rotary head 10 as in the embodiment shown in FIG. 5. The coupling between the ship 6 and the mooring head 10 is carried out by means of two sets of lever arms comprising each one a pair of lever arms 63*a*,63*b* linked to each other. With each set of lever arms is associated a counterweight 64 supported by the mating lever arm 63*a*. The free ends of both lever arms 63*b* are interconnected and pivotally connected to the rotary head 10 for swinging motion about a substantially horizontal pivot pin axis 65. The two other free ends of the lever arms 63*b* which are spaced from each other are factually pivotally connected to both lever arms 63*a*, respectively, through the agency of respective pivot pins or ball-and-socket joints 66. Both lever arms 63*a*, substantially positioned in a vertical plane extend on either side of the ship 6 (with respect to her longitudinal axis) with their free ends being pivotally connected to the ship for swinging motion about respective pivot pins or ball-and-socket joints 67. Both pivot pins of one or each pair of pivot axes 66 or 67 may be coaxially fast with each other as a common rigid axis, rod or shaft 66 and/or 67. In the case of two such rigid common shafts, namely a lower shaft 66 and an upper shaft 67, such shafts form together with the lever arms 63*a* a rigid frame the stiffness of which would contribute to keep the ship at least approximatively directed along an orientation substantially aligned in registering relationship with her mooring point 60 while leaving her some freedom of relative motion but subjecting her to a biasing or draw-back force urging her towards said position of alignment (owing in particular to the combined actions of the counterweights 64 and of the stiffness of the frame 63*a*, 66, 67).

Figure 9:
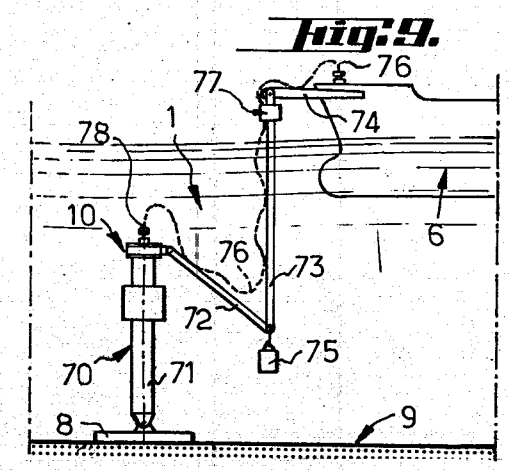
FIG. 9 is a partial elevational view of a sixth embodiment of a mooring system according to the invention.

Referring to FIG. 9, a sixth embodiment of the mooring system 1 according to the invention will be described. The mooring device 70 consists in this instance of an articulated or oscillating column 71 fully underwater which enables the ship 6 to move over the column without hitting it. The coupling between the rotary mooring head 10 which is also submerged and the ship 6 is carried out for instance by means of at least two lever arms 72, 73 linked to each other and pivotally connected respectively to the mooring head 10 and to an overhanging beam structure 74 made fast with the ship 6. The lever arm 73 is extended by a counterweight 74 fully submerged in the sea water. The fluid flow-conveying connections between the column 71 and the ship 6 may be provided through the agency of a flexible hose pipe 76, of the rotary joint 77 mounted in coaxial relation to the lever arm 73 and of a rotary joint 78 provided at the mooring head 10.

In the various embodiments shown in FIGS. 5 to 9, it should be pointed out that the counterweight is this time suspended from the ship 6 and not from the mooring device as in the two first embodiments shown in FIGS. 1 to 4.

Figure 10:
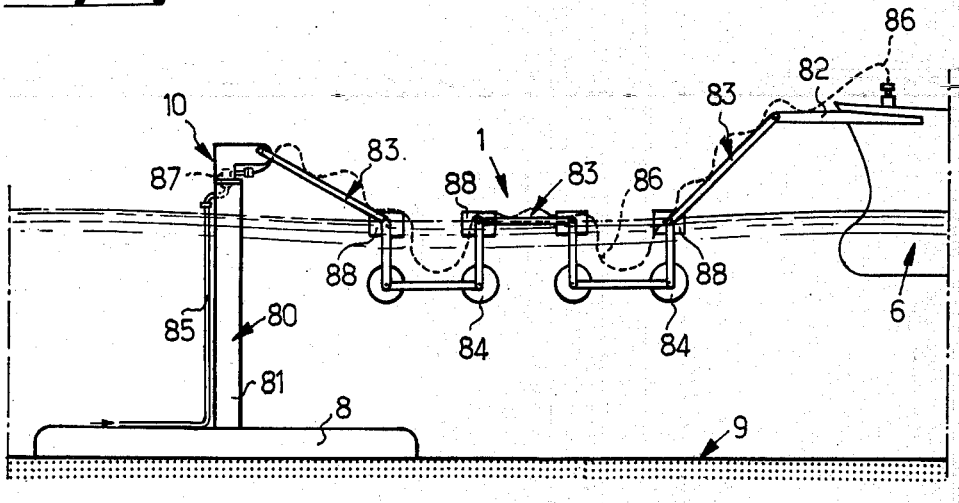
FIG. 10 is a fragmentary elevational view illustrating a seventh embodiment of a mooring system according to the invention.

Referring to FIG. 10 a seventh embodiment of the mooring system according to the invention will be described.

The mooring device 80 consists for instance of a stationary emergent column or tower 81 made rigidly fast with the base member 8 resting on the sea bottom 9. At its top part the tower 81 carries a revolving head 10. The coupling between the revolving head 10 and at least one rigid arm 82 projecting from the stern or rear end or from the prow or fore end of the ship 6 is provided through the agency of several lever arms 83 pivotally interconnected by pairs and having interposed on the one hand several counterweights 84 according to the same principle as in the embodiments illustrated in FIGS. 5 to 9 and on the other hand floats or like buoyant bodies 88.

By increasing the number of lever arms 83 the displacement capabilities of the ship 6 are increased with respect to her mooring point. The fluid flow-conveying connection between one duct or riser 85 held by the stationary column 81 and the ship 6 may be made through the medium of a flexible hose pipe 86 which is more or less guided along the lever arms 83 and of at least one rotary joint 87.

Figure 11:
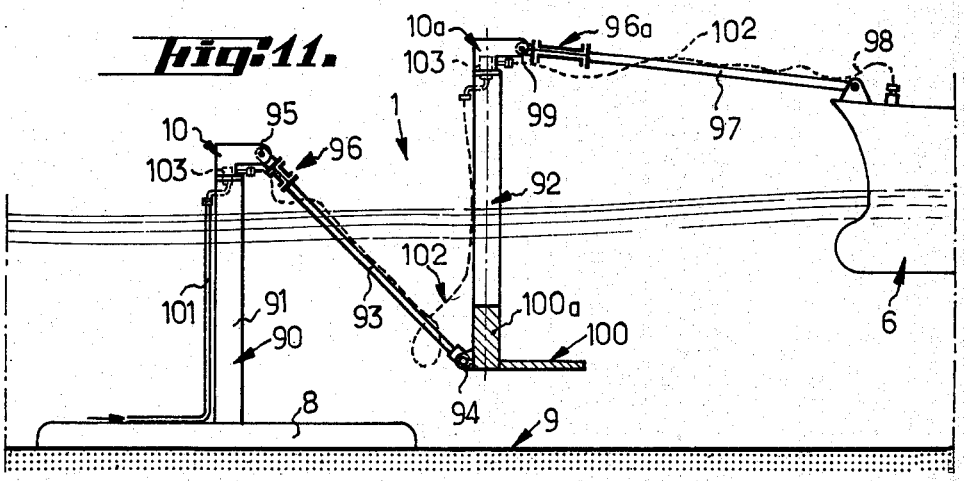
FIG. 11 is a partial elevational view of an eighth embodiment of a mooring system according to the invention.
Figure 12:
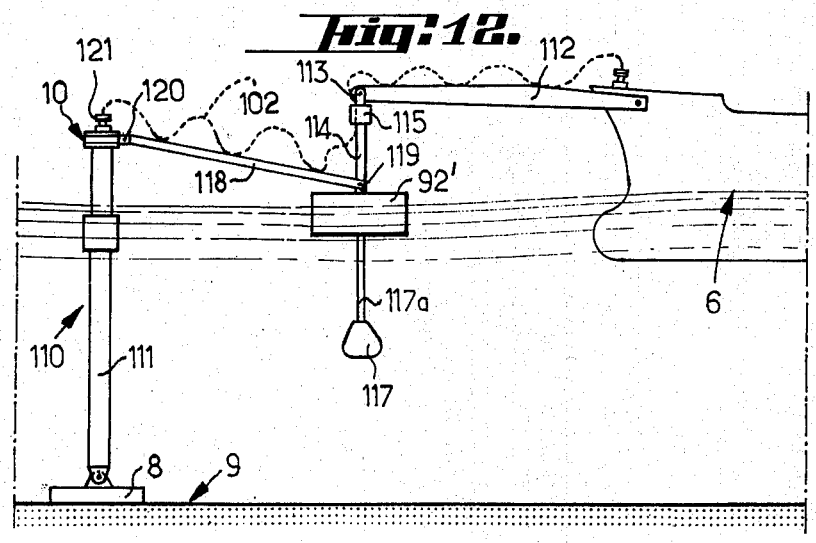
FIG. 12 is a fragmentary elevational view of a ninth embodiment of a mooring system according to the invention.

Referring to FIGS. 11 and 12 the two last embodiments of the mooring system according to the invention will be described, wherein the counterweight is suspended neither from the mooring device nor from the ship but from an intermediate element positioned between the mooring device and the ship.

Referring to FIG. 11 the mooring device 90 comprises for instance as previously a stationary emergent column 91 rigidly connected to a base member 8 resting on the sea floor 9. At the top end of the stationary column 91 is mounted a revolving head 10. The coupling between the revolving head 10 and the ship is provided by a float or like buoyant body 92 which in the rest position of the system extends vertically and emerges partially out of the water. This for instance column-shaped float is connected by one lever arm 93 to the mooring head 10. More specifically the lever arm 93 is pivotally connected with one end thereof for swinging motion about a substantially horizontal pivot pin axis 94 supported by the float 92 towards the bottom portion thereof. The other end of the lever arm 93 is pivotally connected to the mooring head 10 for swinging motion about a pivot pin axis 95 extending in substantially parallel relation to the pivot pin axis 94 and having for instance a rotary joint 96 interposed in coaxially aligned registring relationship with the lever arm 93.

At the upper emerged part of the float 92 is provided a rotary head 10*a* substantially like the mooring head 10. This mooring head 10*a* is coupled to the ship 6 through the agency of a lever arm 97. The latter is pivotally connected to the ship 6 for swinging motion about a substantially horizontal pivot pin axis 98 and with its other end to the rotary head 10*a* for swinging motion about a pivot pin axis 99 extending in substantially parallel relation to the pivot pin axis 98 whereas for instance a rotary joint 96*a* is interposed in coaxially aligned registring relationship with the lever arm 97.

At the lower submerged part of the float 92 is provided a stabilizing plate 100 adapted to brake or slow down the vertical motions of the float 92, together with a ballast weight 100*a* housed in the bottom compartment of the column.

The fluid flow-conveying connection between for instance a duct or riser made fast with the stationary column 91 and the ship 6 is effected through the medium of a flexible hose pipe 102 and of at least two rotary joints 103 provided at both revolving ends 10, and 10*a*, respectively.

The last embodiment of the mooring system 1 according to the invention will be described with reference to FIG. 12. Compared with the foregoing embodiment, the intermediate element consists of a float such as a buoy located at the water surface or under-water. In the examplary embodiment described the buoy is submerged and accordingly stabler.

In this embodiment the mooring device 110 consists of an articulated or oscillating emergent column 111 pivotally connected to the base member 8 resting or anchored on the sea bottom 9. At the emerged end of the column 111 is mounted a revolving head 10. The ship 6 is extended at its stern or rear end or at its prow or fore end by at least one arm 112 at the free end of which is pivotally connected about a substantially horizontal pivot pin axis 113 a lever arm 114 with a rotary joint 115 being interposed in coaxial relation to the longitudinal axis of said arm. This lever arm 114 is secured to a semi-submerged float 92' from which a counterweight 117 is suspended by means of an arm 117*a* rigidly connected to the float. This float or buoy 92' is connected to the mooring head 10 through the agency of a second lever arm 118. One end of the lever arm 118 is pivotally connected about a substantially horizontal pivot pin axis 119 to the first lever arm 114 towards the lower end thereof. The other end of the lever arm 118 is pivotally connected about a substantially horizontal pivot pin axis 120 to the mooring head 10. The fluid flow-conveying connections between the column 111 and the ship 6 are made by means of at least one flexible hose 102 extending through at least one rotary joint 121 (provided at the column) and through the rotary joint 115. The pivotal connection 119 could alternatively be provided on the lower arm 117*a* underneath the float 92'.

It should be noted that in the three foregoing embodiments (FIGS. 3, 4; FIG. 11; FIG. 12), the universal Cardan joint 23 and the rotary joints 96 provide for a better absorption of the forces at the lever arms.

It is significant that in the foregoing embodiments flexible hose pipes have been used for providing the fluid flow-conveying connections between the mooring device and the ship. The use of the flexible hose pipes is however conditioned by the requirement of using pipings of small diameters. With pipings of large diameters fluid-conveying passage-ways extending inside of and through the pivot pin axis should be used as known per se.

It is moreover important to note that to each one of the systems described may be added a damping device as the one shown in FIG. 6. This damping device may however exhibit another shape and may consist of a cable or rope and of an hydraulically operated winch provided with a differential pressure fluid circuit. According to the embodiments discussed the mooring device consists either of a stationary column or of an articulated column. The advantage of the articulated or compliant column consists mainly in the fact that the possible displacement capability of the ship with respect to the mooring device is increased.

All of the embodiments operate according to the same principle, that is when the ship 6 tends to move away from the mooring device, the counterweight through the medium of the lever arms tends to bring her back towards the mooring device.

A ship has been considered mainly in the examplary embodiments shown but the invention may apply likewise to floating storage tanks or more generally to any body required to be moored permanently or not to a mooring device resting upon the sea bed in an articulated manner or not.

It should be understood that the invention is not at all limited to the embodiments which have been shown and described by way of illustrated examples only but it comprises all the technical equivalents of the means described as well as their combinations if same are carried out and used within the scope of the appended claims.

What is claimed is:

1. A system for mooring a ship to a mooring device, the latter being constituted by a column on the top end of which a mooring head is rotatably mounted in coaxial relation thereto, comprising a pair of lever arm sets, each lever arm set being independent from and unconnected to the other lever arm set and including a first lever arm pivotally connected directly to the ship and a second lever arm pivotally connected to said rotatably mounted mooring head with said first and second lever arms being pivotally connected to each other, and wherein each of said lever arm sets is located on a respective side of the longitudinal axis of the ship; and first and second counterweights, each counterweight being secured to one of said first and second lever arms of a respective lever arm set at an end region thereof adjacent to the other lever arm, so that said counterweights are continuously submerged in the sea water to create a stable equilibrium position with a self-acting biasing force urging the system to the equilibrium position.

2. A mooring system according to claim 1, wherein said counterweight-supporting lever arm is the arm pivotally connected to the ship.

3. A mooring system according to claim 1, wherein the said lever arm supporting the counterweight is the arm pivotally connected to the mooring device.

4. A mooring system according to claim 1, wherein said column is a fully submerged column.

5. A mooring system according to claim 1, wherein are provided at least one flexible hose pipe and at least one rotary joint for providing at least one fluid flow-conveying connection between said mooring device and said ship.

6. A mooring system according to claim 1, wherein said column is an emergent column.

* * * * *